US010406578B2

(12) United States Patent
Matsumoto et al.

(10) Patent No.: US 10,406,578 B2
(45) Date of Patent: Sep. 10, 2019

(54) COILER DEVICE PROVIDED WITH CHUTE ROLLER

(71) Applicants: PRIMETALS TECHNOLOGIES JAPAN, LTD., Tokyo (JP); JFE STEEL CORPORATION, Tokyo (JP)

(72) Inventors: Hiroshi Matsumoto, Hiroshima (JP); Masahiro Kuchi, Hiroshima (JP); Yuji Kanko, Hiroshima (JP); Takayuki Endo, Tokyo (JP); Takao Uchiyama, Tokyo (JP); Tsutomu Sugiyama, Tokyo (JP); Takeshi Chiba, Tokyo (JP)

(73) Assignees: PRIMETALS TECHNOLOGIES JAPAN, LTD., Tokyo (JP); JFE STEEL CORPORATION, Tokyo (JP)

( * ) Notice: Subject to any disclaimer, the term of this patent is extended or adjusted under 35 U.S.C. 154(b) by 450 days.

(21) Appl. No.: 15/127,233

(22) PCT Filed: Mar. 18, 2015

(86) PCT No.: PCT/JP2015/057976
§ 371 (c)(1),
(2) Date: Sep. 19, 2016

(87) PCT Pub. No.: WO2015/141702
PCT Pub. Date: Sep. 24, 2015

(65) Prior Publication Data

US 2017/0106422 A1 Apr. 20, 2017

(30) Foreign Application Priority Data

Mar. 20, 2014 (JP) ..... 2014-059065

(51) Int. Cl.
*B21C 47/06* (2006.01)
*B21C 47/34* (2006.01)

(52) U.S. Cl.
CPC ..... *B21C 47/06* (2013.01); *B21C 47/3433* (2013.01); *B21C 47/3441* (2013.01)

(58) Field of Classification Search
CPC . B21C 47/06; B21C 47/3433; B21C 47/3441; B21C 47/146; B21C 47/10;
(Continued)

(56) References Cited

U.S. PATENT DOCUMENTS 2,918,226 A * 12/1959 O'Brien ..... B21C 47/063 72/148
2,937,821 A * 5/1960 O'Brien ..... B21C 47/066 72/148
(Continued)

FOREIGN PATENT DOCUMENTS

FR 2 876 365 A1 4/2006
JP 58-68423 A 4/1983
(Continued)

OTHER PUBLICATIONS

Extended European Search Report dated Nov. 7, 2017 issued in European Patent Application No. 15764398.2.
(Continued)

*Primary Examiner* — Gregory D Swiatocha
(74) *Attorney, Agent, or Firm* — Birch, Stewart, Kolasch & Birch, LLP

(57) ABSTRACT

A coiler device (1), provided with a chute roller (50), has: pinch rollers (10*a*, 10*b*) that lead a metal sheet carried in along a path line (L1) to a coil-up line (L2) that is curved from the path line (L1); a mandrel (20) that coils the metal sheet and is disposed ahead of the coil-up line (L2); and a chute roller (50) that exposes at least the leading end of the metal sheet to the coil-up line (L2) when being wound to the
(Continued)

mandrel (20), and suppresses curving of the metal sheet toward a surface of the metal sheet facing the chute roller (50).

11 Claims, 4 Drawing Sheets

(58) Field of Classification Search
CPC ..... B21C 47/003; B21C 47/08; B21C 47/345; B21C 47/34; B21C 47/04; C21D 9/68; B21B 2015/0057; B21B 39/14; B21B 39/18
USPC ..... 72/148, 146; 29/283.5
See application file for complete search history.

(56) References Cited

U.S. PATENT DOCUMENTS 3,100,605 A 8/1963 Bond
3,587,274 A * 6/1971 Rotter ..... B21C 47/04 72/148
2010/0083720 A1* 4/2010 Hackenberg ..... B21B 38/02 72/8.6
2015/0151345 A1* 6/2015 Fest ..... B21C 47/003 242/418

FOREIGN PATENT DOCUMENTS

JP 2-133114 A 5/1990
JP 4-84621 A 3/1992
JP 4-228217 A 8/1992
JP 2005-305452 A 11/2005
JP 2012-250283 A 12/2012

OTHER PUBLICATIONS

Office Action dated Jun. 22, 2018 issued to the corresponding KR Application No. 2016-7025459 with a concise English translation.
Office Action dated May 9, 2018 issued to the corresponding KR Application No. 2016-7025459 with a concise English translation.

* cited by examiner

COILER DEVICE PROVIDED WITH CHUTE ROLLER

TECHNICAL FIELD

The present invention relates to a coiler device provided with a chute roller.

BACKGROUND ART

In general, a coiler device (a winder) is provided on an exit side of a rolling line, and is configured to wind a metal strip (a strip) into a coil shape, where the metal strip is rolled by a rolling mill and continuously supplied from a gap between rollers. The coiler device is provided with pinch rollers located on a pass line for the metal strip, and is configured to cause the pinch rollers to guide the metal strip to a winding line which is bent obliquely downward from the pass line, to allow a leading end of the metal strip to be caught by a mandrel, and to wind up the metal strip (see Patent Document 1).

Patent Document 1 cited below discloses a method and an apparatus for winding a strip, which are designed to wind a rolled strip around a mandrel through the pinch rollers. The coiler device includes multiple wrapper rollers and wrapper aprons located around the mandrel, and is configured to lead the leading end of the metal strip by using the wrapper aprons and to wrap the metal strip around the mandrel by using the wrapper rollers.

PRIOR ART DOCUMENT

Patent Document

Patent Document 1: Japanese Patent Application Publication No. 2005-305452

SUMMARY OF THE INVENTION

Problems to be Solved by the Invention

In the meantime, after having passed through the pinch rollers, the metal strip changes its passing angle obliquely downward and is thus guided to the mandrel. Here, if the metal strip is a high-strength thick material, the metal strip may be significantly curved toward an upper surface of the winding line between the pinch rollers and the mandrel. In this case, an entry angle of the leading end of the metal strip into a space between the mandrel and the corresponding wrapper roller is changed. As a consequence, there may be a case where the wrapper aprons cannot properly lead the leading end of the metal strip, which may lead to excessive bulge of the metal strip that makes it impossible to wind the metal strip around the mandrel.

The present invention has been made in view of the above-mentioned problem. An object of the present invention is to provide a coiler device provided with a chute roller, which is capable of stably winding a metal strip around a mandrel even when the metal strip is a high-strength thick material.

Means for Solving the Problems

In order to solve the problem described above, the present invention adopts a configuration of a coiler device provided with a chute roller characterized by: a pinch roller configured to guide a metal strip being conveyed along a pass line to a winding line bent from the pass line; a mandrel disposed ahead of the winding line and configured to wind up the metal strip; and a chute roller exposed to the winding line at least when a leading end of the metal strip is about to be wrapped around the mandrel, and configured to suppress a deformation of the metal strip in such a way as to be curved toward an upper surface side of the metal strip.

As a consequence of adopting this configuration, in the present invention, a deformation of the metal strip in such a way as to be curved toward its upper surface side is suppressed by a chute roller which is configured to be exposed to the winding line at least when the leading end of the metal strip is about to be wrapped around the mandrel. As the chute roller blocks bulge of the metal strip, the chute roller is rotated by contact friction with the metal strip and thus converts a force of the metal strip attributed to a tendency to bulge into a pushing force in a traveling direction thereof. Thus, the metal strip can be stably wound around the mandrel while preventing the leading end of the metal strip from being caught by a wrapper apron and the like.

In addition, the present invention adopts a configuration in which the chute roller comes into contact with an apex of a curved surface of the metal strip, and suppresses the deformation of the metal strip in such a way as to be curved toward the upper surface side.

As a consequence of adopting this configuration, in the present invention, it is possible to effectively suppress the bulge of the metal strip by bringing the chute roller into contact with the apex of the curved surface of the metal strip.

In addition, the present invention adopts a configuration in which the chute roller is disposed at a position corresponding to an intermediate position of a tangential path connecting a peripheral surface of the pinch roller to a peripheral surface of the mandrel.

As a consequence of adopting this configuration, in the present invention, since the apex of the curved surface of the metal strip often comes into being at the intermediate position of the tangential path connecting the peripheral surface of the pinch roller to the peripheral surface of the mandrel when the metal strip is a high-strength thick material, it is possible to effectively suppress the bulge of the metal strip by disposing the chute roller at the position corresponding to the intermediate position.

In addition, the present invention adopts a configuration in which the chute roller is disposed away from a tangential path connecting a peripheral surface of the pinch roller to a peripheral surface of the mandrel.

As a consequence of adopting this configuration, in the present invention, it is possible to facilitate the conversion of the force of the metal strip attributed to the tendency to bulge into the pushing force in the traveling direction, by disposing the chute roller away from the tangential path connecting the peripheral surface of the pinch roller to the peripheral surface of the mandrel.

In addition, the present invention adopts a configuration in which: a bending roller being disposed on an upstream side of the pinch roller, and being capable of approaching and receding from the pass line; and a bending roller drive device configured to cause the bending roller to approach the pass line at least when the leading end of the metal strip is about to be wrapped around the mandrel are included.

As a consequence of adopting this configuration, in the present invention, the bending roller disposed on the upstream side of the pinch roller is caused to approach the pass line at least when the leading end of the metal strip is about to be wrapped around the mandrel, so as to suppress lift-up of a portion of the metal strip on the upstream side of the pinch roller. Thus, it is possible to apply a pressure to the metal strip so as to come into contact with a lower part of the chute roller.

In addition, the present invention adopts a configuration in which the chute roller is provided so as to be capable of projecting to and receding from the winding line, and the coiler device comprises a chute roller proceeding and receding device configured to cause the chute roller to recede from the winding line after the leading end of the metal strip is wrapped around the mandrel.

As a consequence of adopting this configuration, in the present invention, the chute roller is caused to recede from the winding line because the guide by the chute controller is not necessary after the leading end of the metal strip is wrapped around the mandrel. Thus, it is possible to suppress wear of the chute roller.

EFFECT OF THE INVENTION

According to the present invention, it is possible to obtain a coiler device provided with a chute roller, which is capable of stably winding a metal strip around a mandrel even when the metal strip is a high-strength thick material.

MODES FOR CARRYING OUT THE INVENTION

Embodiments of the present invention will be described below with reference to the drawings.

(First Embodiment)

Figure 1:
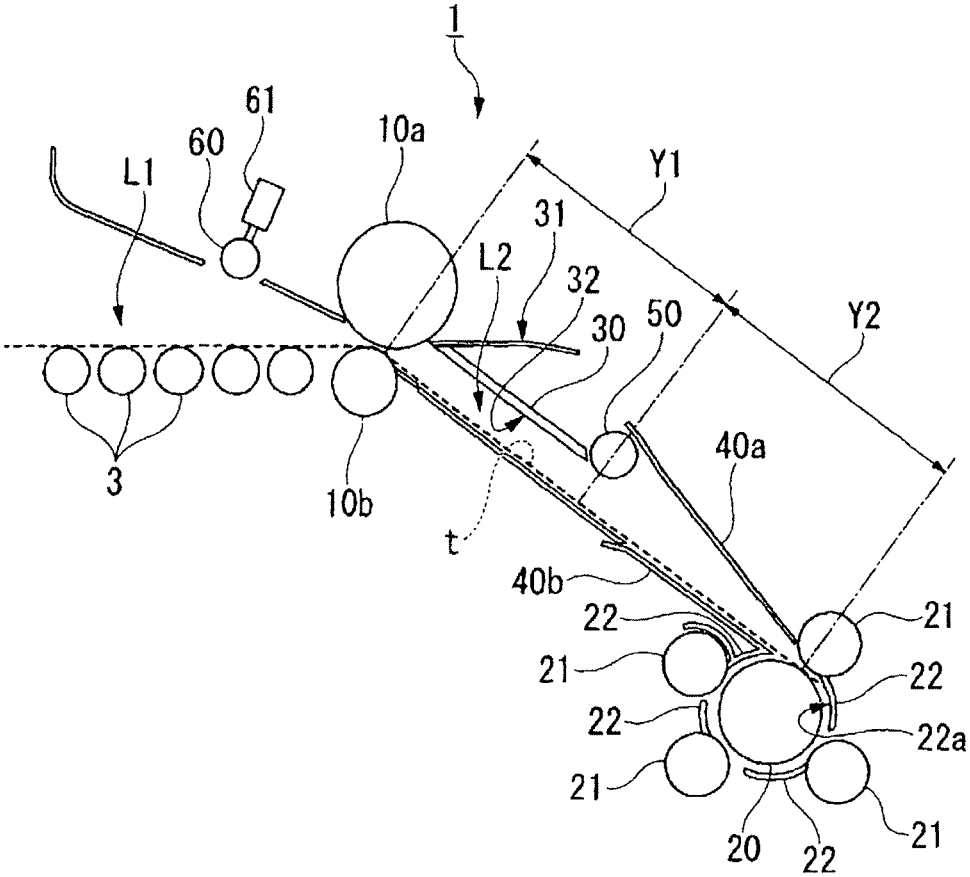
FIG. 1 is a configuration diagram showing a coiler device according to a first embodiment of the present invention.

FIG. 1 is a configuration diagram showing a coiler device 1 according to a first embodiment of the present invention.

The coiler device 1 of this embodiment is disposed on a downstream side of a not-illustrated rolling mill, and is configured to introduce a metal strip 2, which passes through the rolling mill and is conveyed along a pass line L1 (see FIG. 2 and FIG. 3 to be described later), to a winding line L2 and thereby winding up the metal strip 2. The pass line L1 is defined by multiple conveyance rollers 3 that are arranged horizontally.

The coiler device 1 includes pinch rollers 10*a* and 10*b*. The pinch rollers 10*a* and 10*b* are designed to guide the metal strip 2, which is conveyed along the pass line L1, to the winding line L2 that is bent from the pass line L1. The winding line L2 extends obliquely downward from the pass line L1. The upper pinch roller 10*a* is made capable of approaching and receding from the lower pinch roller 10*b*. The upper pinch roller 10*a* is designed to recede from the lower pinch roller 10*b* except in the case of winding the metal strip 2 around a mandrel 20 to be described below.

The coiler device 1 includes the mandrel 20. The mandrel 20 is disposed downstream of the winding line L2 with respect to a traveling direction of the metal strip 2 and designed to wind up the metal strip 2. Multiple wrapper rollers 21 and wrapper aprons 22 are provided around the mandrel 20. The wrapper rollers 21 are provided for wrapping the metal strip 2 around the mandrel 20. The wrapper rollers 21 are disposed at intervals in a circumferential direction of the mandrel 20. The wrapper rollers 21 are made capable of approaching and receding from the mandrel 20. The wrapper rollers 21 are designed to move in conformity with a diameter of the metal strip 2 wrapped around the mandrel 20.

The wrapper aprons 22 are designed to lead a leading end of the metal strip 2 when the metal strip 2 is wrapped around the mandrel 20. Each wrapper apron 22 has a guide surface 22*a*, which is opposed to a peripheral surface of the mandrel 20, and allows the leading end of the metal strip 2 to come into contact therewith. The guide surface 22*a* is curved along the peripheral surface of the mandrel 20. Each wrapper apron 22 is disposed in a space between two corresponding wrapper rollers 21 adjacent to each other in the circumferential direction of the mandrel 20. The wrapper aprons 22 are made capable of approaching and receding from the mandrel 20. The wrapper aprons 22 are designed to recede from the mandrel 20 when the metal strip 2 is wrapped therearound.

The coiler device 1 includes a gate 30. The gate 30 is configured to open and close the winding line L2 (FIG. 1 shows an open state). The gate 30 is disposed on an exit side of the pinch rollers 10*a* and 10*b*. The gate 30 includes a first guide surface 31 that defines the pass line L1, and a second guide surface 32 that defines the winding line L2. The first guide surface 31 is formed into a horizontal surface extending along the pass line L1. The second guide surface 32 is formed into an inclined surface extending along the winding line L2. The gate 30 has a structure in which a tip end of a substantially V shape is directed to an upstream side of the pass line L1.

The gate 30 defines the winding line L2 in conjunction with chute guides 40*a* and 40*b*. The chute guides 40*a* and 40*b* are designed to guide the leading end of the metal strip 2 to a catch part between the mandrel 20 and the corresponding wrapper roller 21. The chute guides 40*a* and 40*b* are arranged in a downward tapered fashion such that a clearance therebetween is gradually narrowed toward the catch part between the mandrel 20 and the wrapper roller 21. The chute guides 40*a* and 40*b* are disposed on a downstream side of the gate 30 in the winding line L2. In this embodiment, the lower chute guide 40*b* is provided integrally with one of the wrapper aprons 22.

The coiler device 1 includes a chute roller 50. The chute roller 50 is configured to be exposed to the winding line L2 at least when the leading end of the metal strip 2 is about to be wrapped around the mandrel 20, and to suppress a deformation of the metal strip 2 in such a way as to be curved toward its upper surface side (see FIG. 2 and FIG. 3 to be described later). The chute roller 50 is disposed at a position on the downstream side of the gate 30 on the winding line L2, the position corresponding to a joint between the gate 30 and the upper chute guide 40*a*. The chute roller 50 is rotatably provided and its peripheral surface projects from the second guide surface 32.

The chute roller 50 is disposed at a position corresponding to an intermediate position of a tangential path t connecting a peripheral surface of the pinch roller 10*b* to the peripheral surface of the mandrel 20. In other words, the chute roller 50 is disposed such that a distance Y1 from a catch part between the pinch rollers 10*a* and 10*b* to the chute roller 50 becomes equal to a distance Y2 from the catch part between the mandrel 20 and the wrapper roller 21 to the chute roller 50. Moreover, the chute roller 50 is disposed away from the tangential path t which connects the peripheral surface of the pinch roller 10*b* to the peripheral surface of the mandrel 20. To put it another way, the chute roller 50 is disposed so as not to come into contact with the metal strip 2 while the metal strip 2 is properly wound around the mandrel 20 and is conveyed in line with the tangential path t.

The coiler device 1 includes a bending roller 60. The bending roller 60 is disposed on an upstream side of the pinch rollers 10*a* and 10*b*, and is made capable of approaching and receding from the pass line L1 by use of a bending roller drive device 61. The bending roller 60 is configured mainly to approach the pass line L1 when the rolling of the metal strip 2 is about to finish, so as to prevent its trailing end from bouncing up. Meanwhile, in this embodiment, the bending roller 60 is configured to approach the pass line L1 by using the bending roller drive device 61 at least when the leading end of the metal strip 2 is about to be wrapped around the mandrel 20. The bending roller drive device 61 is formed from a cylinder device, for example.

Next, an operation to wind the metal strip 2 by the coiler device 1 configured as described above will be explained with reference to FIG. 2 and FIG. 3. Note that a description is given below of a case where the metal strip 2 is a high-strength thick material.

Figure 2A:
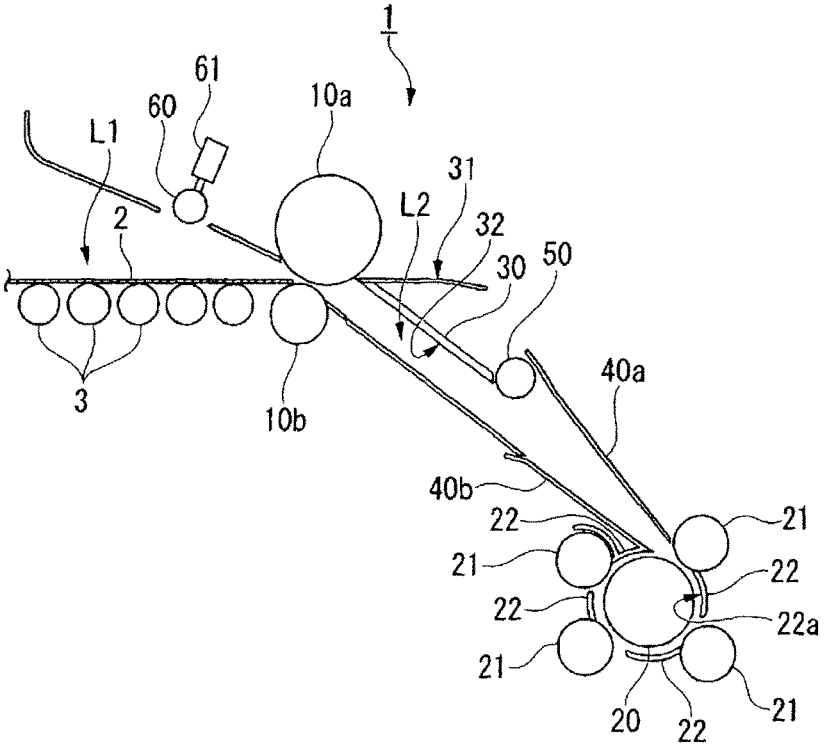
FIG. 2 illustrates diagrams for explaining a winding operation of the coiler device according to the first embodiment of the present invention.
Figure 2B:
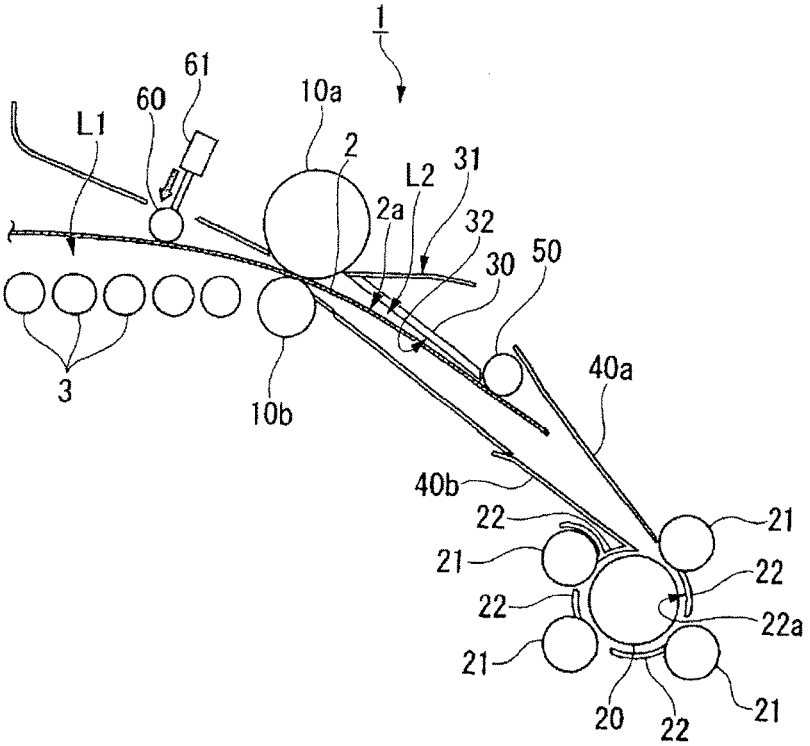
Figure 3A:
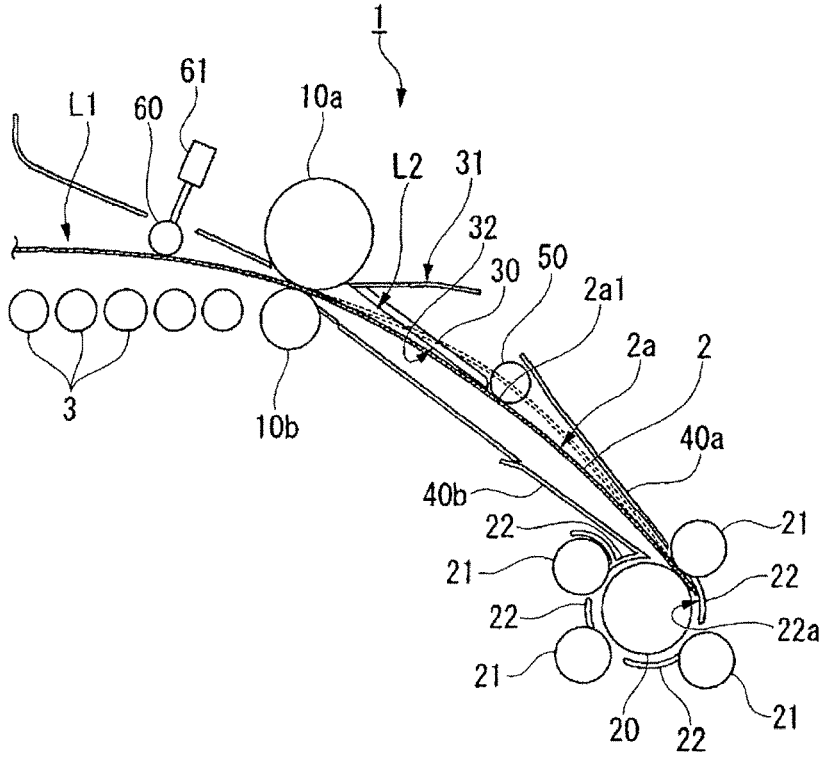
FIG. 3 illustrates diagrams for explaining the winding operation of the coiler device according to the first embodiment of the present invention.
Figure 3B:
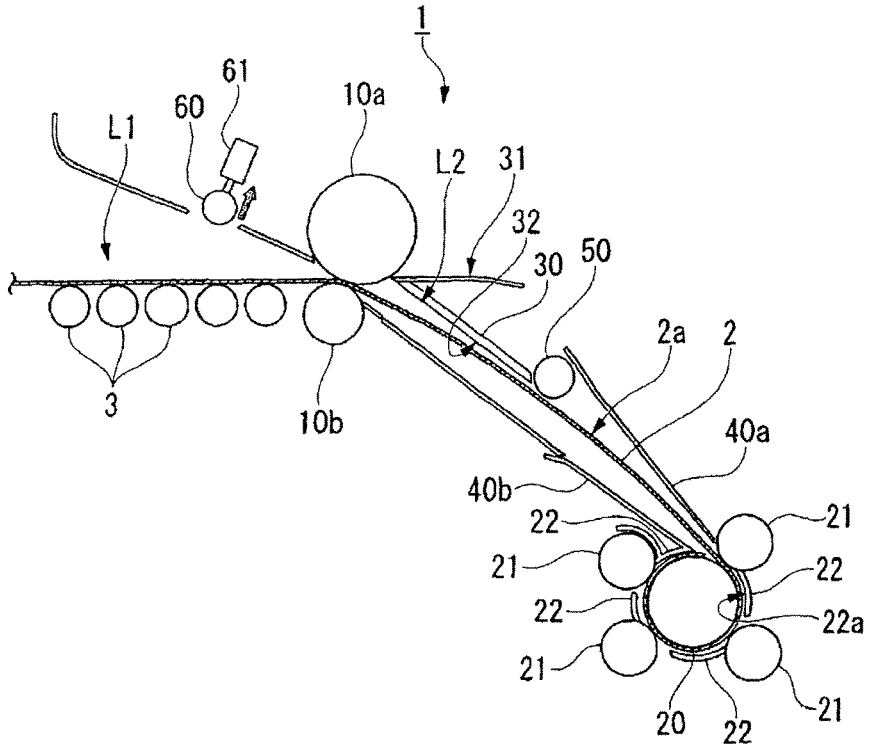

FIG. 2 and FIG. 3 illustrate diagrams for explaining a winding operation of the coiler device 1 according to the first embodiment of the present invention.

As shown in FIG. 2(*a*), the metal strip 2 having passed through the not-illustrated rolling mill is conveyed along the pass line L1 and reaches the pinch rollers 10*a* and 10*b*.

As shown in FIG. 2(*b*), after having passed through the pinch rollers 10*a* and 10*b*, the metal strip 2 changes its passing angle obliquely downward and is thus guided to the winding line L2 which is bent from the pass line L1. Here, when the metal strip 2 is the high-strength thick material, its leading end is not bent enormously but is instead curved in such a way as to draw an arc.

As the metal strip 2 is curved, its portion on the upstream side of the pinch rollers 10*a* and 10*b* is also curved and lifted up from the pass line L1. At this time, the bending roller drive device 61 causes the bending roller 60, which is disposed on the upstream side of the pinch rollers 10*a* and 10*b*, to approach the pass line L1, thereby suppressing the lift-up of the portion of the metal strip 2 on the upstream side of the pinch rollers 10*a* and 10*b*. Thus, it is possible to bring the leading end of the metal strip 2 closer to the second guide surface 32 of the gate 30 and to the location where the upper chute guide 40*a* is disposed, and to apply a pressure to the aforementioned curved surface 2*a* that is curved toward the upper surface side so as to come into contact with a lower part of the chute roller 50.

As shown in FIG. 3(*a*), the metal strip 2 passes through a space between the chute guides 40*a* and 40*b* while being subjected to friction reduction by means of rotation of the chute roller 50, and is then guided to the catch part between the mandrel 20 and the wrapper roller 21. The leading end of the metal strip 2 having passed through the space between the mandrel 20 and the wrapper roller 21 comes into contact with the curved guide surface 22*a* of the wrapper apron 22. Here, when the metal strip 2 is the high-strength thick material, the leading end of the metal strip 2 is not bent very much by the engagement with one wrapper roller 21 only. Hence, a pushing force in a traveling direction is required in order to break a constraint attributed to a static frictional force between the leading end of the metal strip 2 and the wrapper apron 22.

When the leading end of the metal strip 2 comes into contact with the wrapper apron 22, the metal strip 2 tends to bulge toward its upper surface side (illustrated with dotted lines in FIG. 3(*a*)) as the metal strip 2 is conveyed sequentially. The chute roller 50 is exposed to the winding line L2 when the leading end of the metal strip 2 is wrapped around the mandrel 20, and thus suppresses a deformation of the metal strip 2 in such a way to be curved toward its upper surface side. When the bulge of the metal strip 2 is blocked by the chute roller 50, the chute roller 50 is rotated by contact friction with the metal strip 2, and thus converts a force of the metal strip 2 attributed to the tendency to bulge into a pushing force in the traveling direction.

The action of the chute roller 50 brings about the pushing force for releasing a constraint attributed to a static frictional force between the metal strip 2 and the wrapper apron 22, whereby the leading end of the metal strip 2 slides on the guide surface 22*a* of the wrapper apron 22, and then comes into engagement with the subsequent wrapper roller 21 disposed on the downstream side thereof. As described above, by providing the chute roller 50, the metal strip 2 can be stably wound around the mandrel 20 in this embodiment as shown in FIG. 3(*b*) while preventing the leading end of the metal strip 2 from being caught by the wrapper apron 22.

In this embodiment, the chute roller 50 is disposed at the position corresponding to the intermediate position of the tangential path t connecting the peripheral surface of the pinch roller 10*b* to the peripheral surface of the mandrel 20. When the metal strip 2 is the high-strength thick material, an apex 2*a*1 of the curved surface 2*a* of the metal strip 2 often comes into being at the intermediate position between the pinch rollers 10*a* and 10*b* and the mandrel 20 as shown in FIG. 3(*a*). Accordingly, by disposing the chute roller 50 at the position corresponding to the intermediate position, it is possible to bring the chute roller 50 into contact with the apex 2*a*1 of the curved surface 2*a* of the metal strip 2, thereby effectively suppressing the deformation of the metal strip 2 in such a way to be curved toward its upper surface side.

Moreover, in this embodiment, the chute roller 50 is disposed away from the tangential path t which connects the peripheral surfaces of the pinch rollers 10*a* and 10*b* to the peripheral surface of the mandrel 20. If the chute roller 50 is disposed in contact with the tangential path t, the metal strip 2 cannot bulge toward its upper surface side and the force attributed to the tendency to bulge cannot be converted into the pushing force in the traveling direction. In addition, there maybe a case of occurrence of an unanticipated deformation such as the metal strip 2 being curved toward its lower surface on the opposite side. Accordingly, in this embodiment, the chute roller 50 is located away from the tangential path t so as to facilitate the conversion of the force of the metal strip 2 attributed to the tendency to bulge into the pushing force in the traveling direction.

As shown in FIG. 3(*b*), when the leading end of the metal strip 2 is wrapped around the mandrel 20, a tensile force is applied to the metal strip 2 whereby the lift-up of the metal strip 2 is reduced. After the leading end of the metal strip 2 is wrapped around the mandrel 20, it is no longer necessary to prevent the lift-up of the metal strip 2 by using the bending roller 60. Accordingly, the bending roller drive device 61 detaches the bending roller 60 from the pass line L1. Meanwhile, the lead by the wrapper aprons 22 is no longer necessary when the leading end of the metal strip 2 is wrapped around the mandrel 20. Accordingly, the wrapper aprons 22 are detached from the mandrel 20 and the metal strip 2 is wound around the mandrel 20 by using the multiple wrapper rollers 21 until the wound metal strip 2 forms a predetermined diameter.

Thus, the operation to wind the metal strip 2 by the coiler device 1 is completed.

In this way, the above-described embodiment adopts the configuration of the coiler device 1, including: the pinch rollers 10*a* and 10*b* configured to guide the metal strip 2, which is conveyed along the pass line L1, to the winding line L2 bent from the pass line L1; and the mandrel 20 disposed downstream of the winding line L2 and configured to wind up the metal strip 2, in which the coiler device 1 includes the chute roller 50 that is exposed to the winding line L2 at least when the leading end of the metal strip 2 is about to be wrapped around the mandrel 20, and suppresses the deformation of the metal strip 2 in such a way as to be curved toward its upper surface side. Thus, it is possible to obtain the coiler device 1 provided with the chute roller 50, which is capable of stably winding the metal strip 2 around the mandrel 20 even when the metal strip 2 is the high-strength thick material.

(Second Embodiment)

Next, a second embodiment of the present invention will be described. In the following description, constituents which are identical or similar to those in the above-mentioned embodiment will be denoted by the same reference numerals and the description thereof will be either simplified or omitted.

Figure 4:
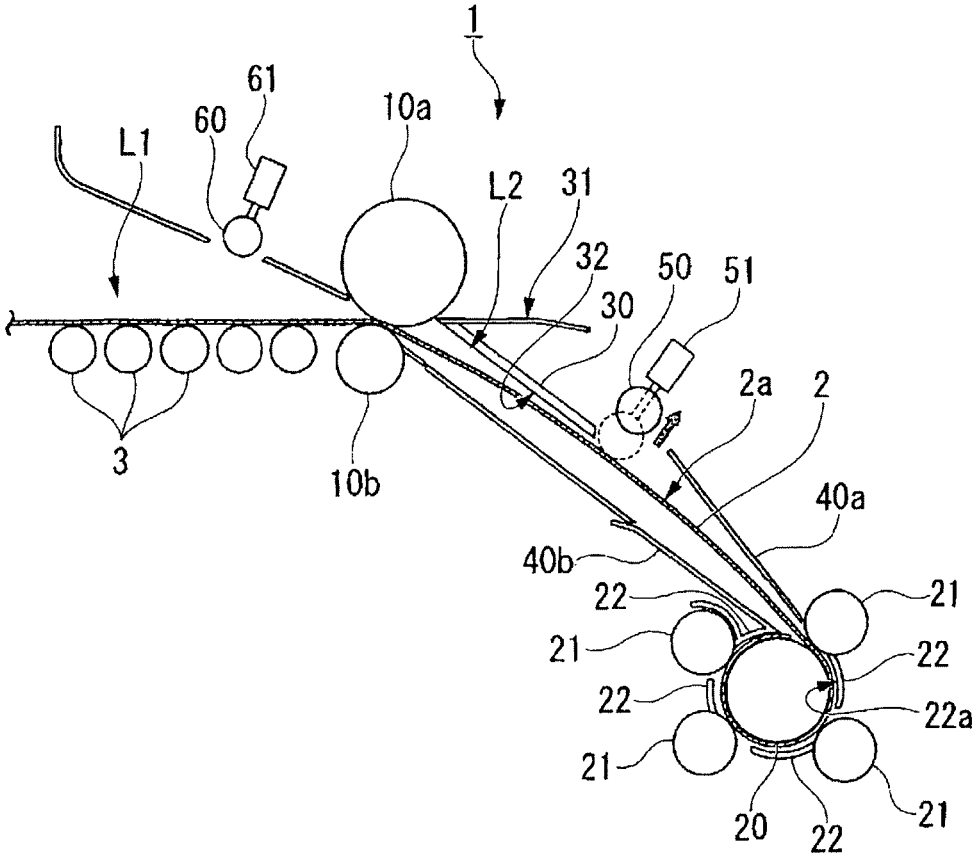
FIG. 4 is a configuration diagram showing a coiler device according to a second embodiment of the present invention.

FIG. 4 is a configuration diagram showing the coiler device 1 according to the second embodiment of the present invention.

As shown in FIG. 4, the second embodiment is different from the above-mentioned embodiment in that a chute roller proceeding and receding device 51 is provided thereto.

The chute roller 50 of the second embodiment is supported by the chute roller proceeding and receding device 51, and is made capable of projecting to and receding from the winding line L2.

The chute roller proceeding and receding device 51 is configured to move the chute roller 50 between a projecting position (which is indicated with a dashed line in FIG. 4) to project beyond the second guide surface 32 of the gate 30 and a receding position (which is indicated with a solid line in FIG. 4) to recede from the second guide surface 32 of the gate 30. The chute roller proceeding and receding device 51 is configured to move the chute roller 50 to the projecting position when the leading end of the metal strip 2 is about to be wrapped around the mandrel 20, and to move the chute roller 50 to the receding position after the leading end of the metal strip 2 is wrapped around the mandrel 20. The chute roller proceeding and receding device 51 is formed from a cylinder device, for example.

According to the second embodiment having the above-mentioned configuration, as shown in FIG. 4, the chute roller proceeding and receding device 51 can cause the chute roller 50 to recede from the winding line L2 after the leading end of the metal strip 2 is wrapped around the mandrel 20. Since the guide by the chute roller 50 is not necessary after the leading end of the metal strip 2 is wrapped around the mandrel 20, the chute roller 50 and the metal strip 2 are kept from coming into contact with each other by causing the chute roller 50 to recede from the winding line L2. Thus, it is possible to suppress wear of the chute roller 50 and to improve product life of the chute roller 50.

The preferred embodiments of the present invention have been described above with reference to the drawings. It is to be understood, however, that the present invention is not limited only to the above-described embodiments. The shapes, combinations, and other features of the respective constituents shown in the above-described embodiments are mere examples, and various modifications based on design requirements and the like are possible within the range not departing from the gist of the present invention.

For example, the embodiments have described the configuration in which the chute roller is rotatably provided. However, the present invention is not limited only to this configuration. For instance, the chute roller may be connected to a motor device and the like and configured to be rotated autonomously. As a consequence of the autonomous rotation of the chute roller, it is possible to apply a larger pushing force to the metal strip, and thus to wrap the metal strip around the mandrel more smoothly.

Meanwhile, for example, the embodiments have described the configuration in which only one chute roller is provided at the intermediate position between the pinch rollers and the mandrel. However, the present invention is not limited only to this configuration. For instance, the present invention may adopt a configuration to provide multiple chute rollers each having a smaller diameter.

Furthermore, for example, the embodiments have described the configuration in which the multiple wrapper rollers and wrapper aprons are provided around the mandrel. However, the present invention is not limited only to this configuration. For instance, the present invention may adopt a configuration to provide a wrapper belt around the mandrel.

EXPLANATION OF REFERENCE NUMERALS

1 coiler device
2 metal strip
2*a* curved surface
2*a*1 apex
10*a*, 10*b* pinch roller
20 mandrel
50 chute roller
51 chute roller proceeding and receding device
60 bending roller
61 bending roller drive device
L1 pass line
L2 winding line
t tangential path

The invention claimed is:

1. A coiler device provided with a chute roller, comprising:

a pinch roller configured to guide a metal strip being conveyed along a pass line to a winding line bent from the pass line;

a mandrel disposed downstream of the winding line with respect to a traveling direction of the metal strip and configured to wind up the metal strip; and the chute roller configured to suppress an upward movement of the metal strip away from the mandrel, a chute guide disposed between the mandrel and the chute roller and configured to guide a leading end of the metal strip so as to be wrapped around the mandrel;

a bending roller being disposed on an upstream side of the pinch roller with respect to the traveling direction of the metal strip, and being capable of approaching and receding from the pass line;

a bending roller drive configured to cause the bending roller to approach the pass line to apply a pressure to the metal strip so that the metal strip comes into contact with the chute roller at least when the leading end of the metal strip is about to be wrapped around the mandrel.

2. The coiler device provided with the chute roller according to claim 1, wherein the chute roller comes into contact with an apex of a curved surface of the metal strip, and suppresses the upward movement of the metal strip away from the mandrel.

3. The coiler device provided with the chute roller according to claim 2, wherein the chute roller is disposed at a position corresponding to an intermediate position of a tangential path connecting a peripheral surface of the pinch roller to a peripheral surface of the mandrel.

4. The coiler device provided with the chute roller according to claim 2, wherein the chute roller is disposed away from a tangential path connecting a peripheral surface of the pinch roller to a peripheral surface of the mandrel.

5. The coiler device provided with the chute roller according to claim 2, wherein the chute roller is provided so as to be capable of projecting to and receding from the winding line, and the coiler device comprises a chute roller proceeding and receding drive configured to cause the chute roller to recede from the winding line after the leading end of the metal strip is wrapped around the mandrel.

6. The coiler device provided with the chute roller according to claim 1, wherein the chute roller is disposed at a position corresponding to an intermediate position of a tangential path connecting a peripheral surface of the pinch roller to a peripheral surface of the mandrel.

7. The coiler device provided with the chute roller according to claim 6, wherein the chute roller is disposed away from a tangential path connecting a peripheral surface of the pinch roller to a peripheral surface of the mandrel.

8. The coiler device provided with the chute roller according to claim 6, wherein the chute roller is provided so as to be capable of projecting to and receding from the winding line, and the coiler device comprises a chute roller proceeding and receding drive configured to cause the chute roller to recede from the winding line after the leading end of the metal strip is wrapped around the mandrel.

9. The coiler device provided with the chute roller according to claim 1, wherein the chute roller is disposed away from a tangential path connecting a peripheral surface of the pinch roller to a peripheral surface of the mandrel.

10. The coiler device provided with the chute roller according to claim 9, wherein the chute roller is provided so as to be capable of projecting to and receding from the winding line, and the coiler device comprises a chute roller proceeding and receding drive configured to cause the chute roller to recede from the winding line after the leading end of the metal strip is wrapped around the mandrel.

11. The coiler device provided with the chute roller according to claim 1, wherein the chute roller is provided so as to be capable of projecting to and receding from the winding line, and the coiler device comprises a chute roller proceeding and receding drive configured to cause the chute roller to recede from the winding line after the leading end of the metal strip is wrapped around the mandrel.

* * * * *